United States Patent [19]

Stricker et al.

[11] Patent Number: 4,611,529

[45] Date of Patent: Sep. 16, 1986

[54] AXIAL PISTON MACHINE CONSTRUCTED IN A REMOVABLE CARTRIDGE FORM TO FACILITATE ASSEMBLY AND DISASSEMBLY

[75] Inventors: Peter A. Stricker, Jackson; John J. Schweitzer, Brandon, both of Miss.

[73] Assignee: Vickers, Incorporated, Troy, Mich.

[21] Appl. No.: 630,074

[22] Filed: Jul. 12, 1984

[51] Int. Cl.[4] ..... F01B 13/04

[52] U.S. Cl. ..... 91/499; 417/269; 417/271; 417/360; 92/128

[58] Field of Search ..... 91/472, 499; 92/57, 92/71, 128; 417/269-271, 360

[56] References Cited

U.S. PATENT DOCUMENTS

| | | | |
|---|---|---|---|
| 3,274,896 | 9/1966 | Terho | 91/499 X |
| 3,808,949 | 5/1974 | Muncke et al. | 91/473 |
| 3,872,562 | 3/1975 | Pestel | 29/156.4 R |
| 4,207,804 | 6/1980 | Fukui | 91/499 |
| 4,281,971 | 8/1981 | Kouns | 417/203 |
| 4,357,858 | 11/1982 | Wedman | 92/128 |

FOREIGN PATENT DOCUMENTS

| | | | |
|---|---|---|---|
| 6848 | 1/1977 | Japan | 91/499 |

*Primary Examiner*—William L. Freeh
*Assistant Examiner*—Paul F. Neils
*Attorney, Agent, or Firm*—Barnes, Kisselle, Raisch, Choate, Whittemore & Hulbert

[57] ABSTRACT

A fluid pressure energy translating device comprising a housing defining a cavity and a drive shaft having a portion thereof rotatably mounted in the housing and extending into the cavity. The cavity has an open end remote from the drive shaft and a valve block closes the open end of the housing. A removable rotating group cartridge is positioned in the cavity between the valve block and drivingly engaged with the shaft. The cartridge comprises a valve plate engaging the valve block and an angle block, a rotatable cylinder barrel interposed between said valve plate and said angle block in abutment with the valve plate and in driving relation with the drive shaft. The cylinder barrel has a plurality of piston cylinders, each of which has a port for communicating the cylinders with a face of the valve plate, a piston in each cylinder, shoes connected to the pistons and engaging an inclined surface on the angle block. The valve plate and angle block are interconnected to form a removable cartridge.

26 Claims, 6 Drawing Figures

AXIAL PISTON MACHINE CONSTRUCTED IN A REMOVABLE CARTRIDGE FORM TO FACILITATE ASSEMBLY AND DISASSEMBLY

This invention relates to power transmission and particularly to power transmission of the type comprising fluid pressure energy translating devices which may function as a pump of a fluid motor.

BACKGROUND AND SUMMARY OF THE INVENTION

A common type of fluid pressure energy translating device comprises a housing which contains a rotating group of the axial piston type such as shown in U.S. Pat. Nos. 2,776,628, 3,457,873 and 3,481,277.

In devices of this type, a rotating group is mounted in a cavity of a housing and comprises a rotary cylinder barrel in the cavity which is driven or drives a shaft and has a plurality of axial cylinders in which pistons are positioned. The ends of the pistons are connected to shoes which engage an inclined surface and the cylinders communicate through openings with an inlet or outlet in a valve plate positioned adjacent and engaging the cylinder barrel. As the barrel rotates, the fluid is either pumped into or out of the cylinders depending upon whether the device is being used as a pump or motor.

In the maintenance of such a device, it is necessary to take the device apart and replace the various components such as the cylinder barrel, pistons, shoes and associated seals. Handling of the separate parts is costly and time consuming.

Among the objectives of the present invention are to provide a fluid pressure energy translating device which will permit rapid field replacement of the rotating components and seals; which utilizes a cartridge containing the rotating parts and seals which may be readily removed and replaced by a new cartridge; which cartridge can readily be engaged with a drive shaft rotatably mounted in a housing and located within the cavity of the housing.

In accordance with the invention, the fluid pressure energy translating device comprises a housing defining a cavity, a drive shaft having a portion thereof rotatably mounted in the housing and extending into the cavity. The cavity has an open end remote from said drive shaft. A valve block closes the open end of said housing. A rotating group cartridge is positioned in the cavity between the valve block and is drivingly engaged with the shaft. The cartridge comprises a valve plate engaging the valve block and an angle block. A rotatable cylinder barrel is interposed between the valve plate and angle block in abutment with the valve plate and in driving relation with the drive shaft. The cylinder barrel has a plurality of piston cylinders, each of which has a port for communicating the cylinders with a face of the valve plate, a piston in each said cylinder, shoes connected to the pistons and engaging an inclined surface on the angle block and means interconnecting the valve plate and angle block to form a removable cartridge.

DESCRIPTION

Figure 1:
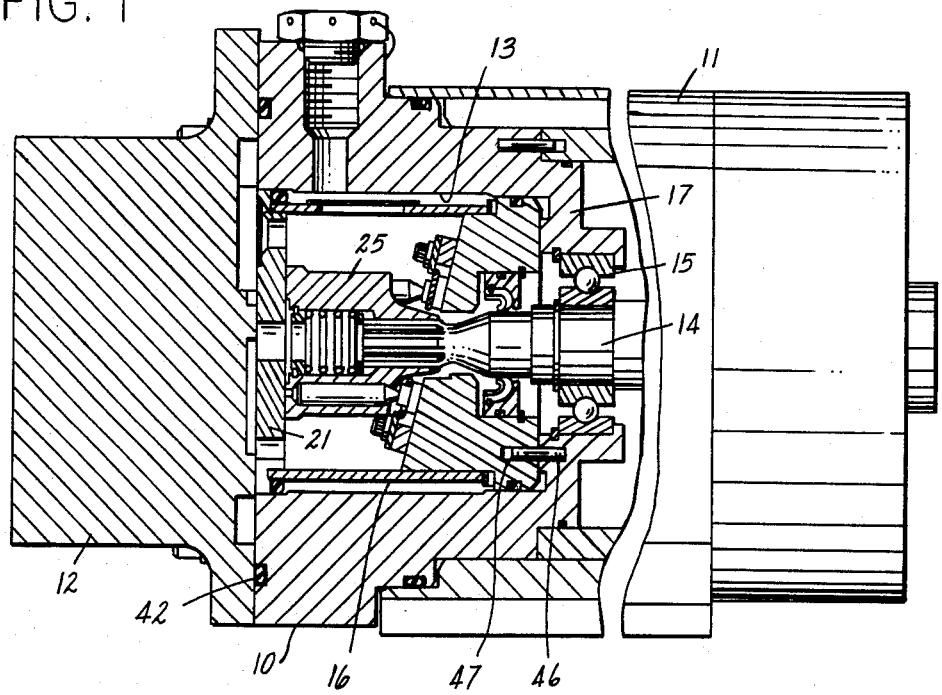
FIG. 1 is a fragmentary longitudinal part sectional view of a fluid pressure energy translating device embodying the invention.
Figure 2:
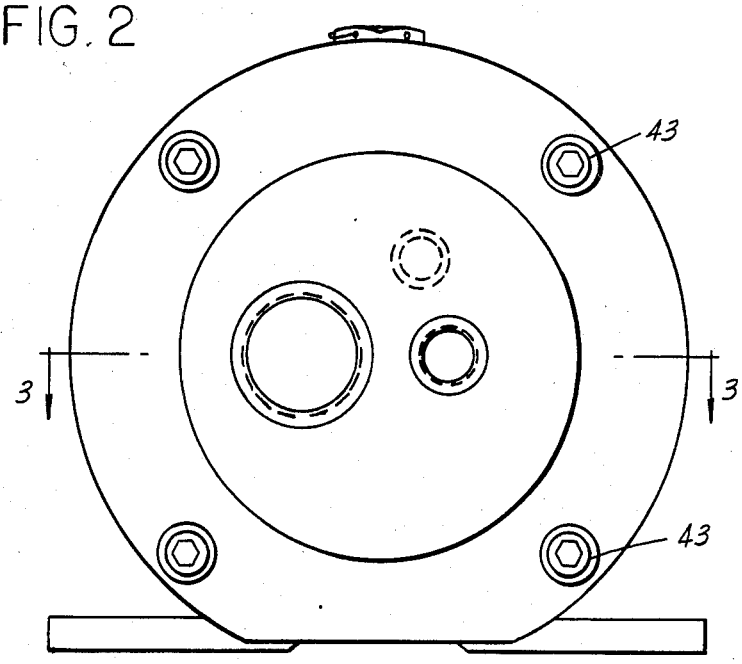
FIG. 2 is an end view taken from the left as viewed in FIG. 1.

Referring to FIGS. 1–5, the pressure energy translating device embodying the invention comprises a housing 10 that is adapted to be positioned in the end of an electric motor 11, where the device is a pump, or in a comparable housing of a drive shaft, where the device is to be operated as a motor.

The device further includes a valve block 12 closing the open end of a chamber or cavity 13 in the housing. A shaft 14 from the housing 11 is journalled by a bearing 15 in an opening in the end of the housing 10 and extends into the cavity 13.

In accordance with the invention, a rotating group cartridge 16 is interposed between the valve block 12 and the end wall 17 of the housing 10.

Figure 3:
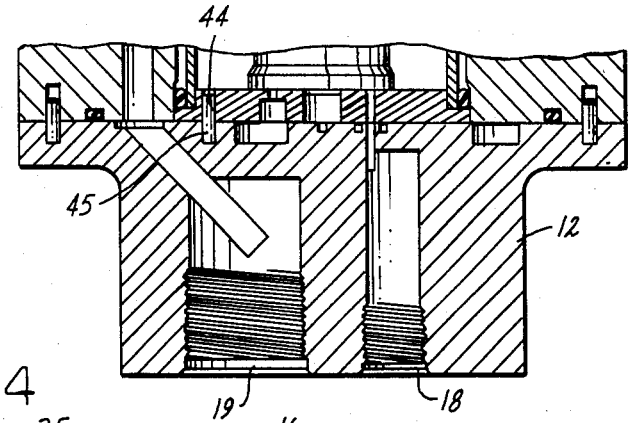
FIG. 3 is a fragmentary sectional view taken along the line 3—3 in FIG. 2.
Figure 4:
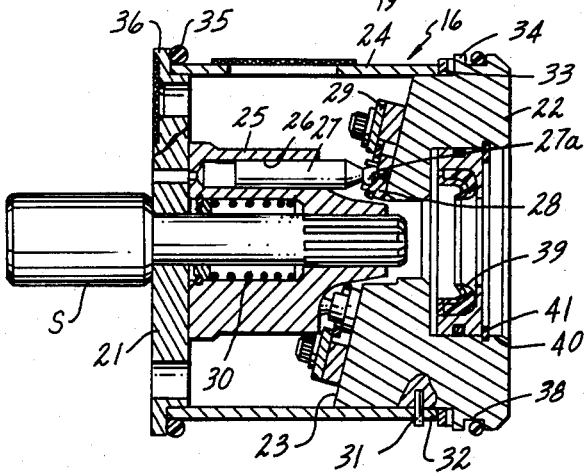
FIG. 4 is a sectional view on an enlarged scale of the cartridge with a retainer rod.
Figure 6:
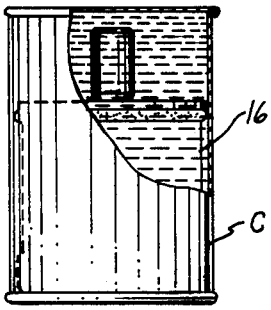
FIG. 6 is a part sectional view of the container and cartridge package that can be used in handling and shipping the cartridge.
Figure 5:
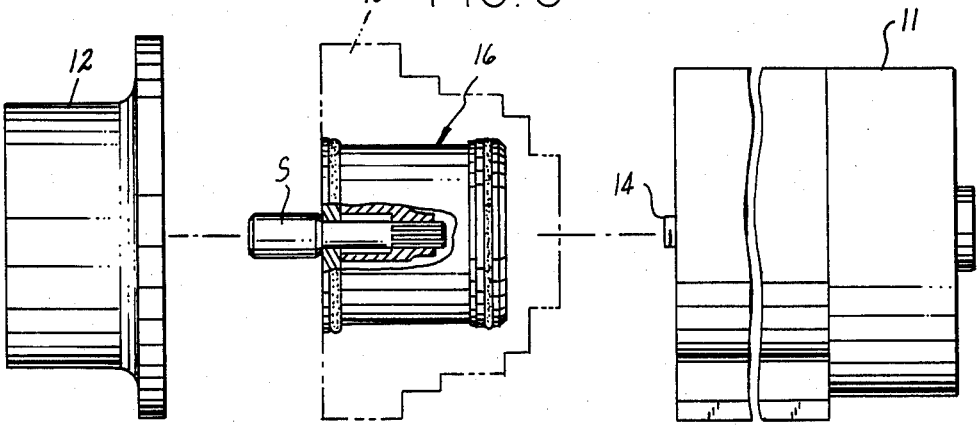
FIG. 5 is a partly diagrammatic view showing the manner in which a cartridge may be replaced.

As shown in FIGS. 3 and 4, the end block 12 includes spaced openings 18, 19 which may function as an inlet or outlet, depending upon the direction of rotation of the rotating group in the cartridge 16, as is well known in the art.

Referring to FIG. 4, the cartridge 16 comprises a valve plate 21, an angle block 22 having an inclined surface 23 and a tubular casing 24 interconnecting the valve plate 21 and angle block 22. A cylinder barrel 25 is provided and includes a plurality of axial cylinders 26 in which pistons 27 are mounted and have their outer ends **27*a* formed with spherical surfaces engaging shoes 28 which are retained against the angular surface 23 by retainer 29, as is well known in the art. A spring 30 is provided and urges the cylinder barrel 25 against the valve plate 21**. The operation of the rotating group as a pump or motor is in a well known manner as shown in the aforementioned U.S. patents, which are incorporated herein by reference.

A pin 31 extends radially from the angle block 22 through an axially elongated opening 32 in the casing 24 so that there is limited permissible movement axially between the casing 24 and the angle block 22 and an undulating spring 33 is interposed between the casing 24 and a flange 34 on the angle block 22. An O-ring 35 is provided on a flange 36 of the valve plate 21 and O-ring 38 is provided in a groove 38 on the periphery of the angle block 22. Finally, the cartridge includes a radial shaft seal 39 which is held in position in a recess 40 by a snap ring 41 to provide a seal for the shaft 14. An annular sealing ring 42 in a groove in the end face of housing 10 provides a seal with valve block 12. A removable plastic rod S is provided in the cartridge 16 to maintain the parts in alignment before the cartridge 16 is used.

When it is desired to replace the cartridge 16, the valve block 12 is removed by loosening and removing bolts 43 so that the cartridge subassembly can be removed and replaced by a new cartridge subassembly.

The cartridge 16 is preferably handled and stored by placement in a container C filled with clean oil and closed by a suitable closure, the oil being of the type utilized in the hydraulic system.

The steps to be followed are as follows:

1. The old cartridge is removed from the housing.

2. The new cartridge is removed from its sealed container and inserted into the housing (shaft seal end first).

3. Before the angle block bottoms in the housing, the cartridge is rotated back and forth until a hole in the angle block 22 engages a locating pin 46 in the housing 10; and then the cartridge is pressed in firmly.

4. As the cartridge is inserted (step 3), the drive shaft extension 14 pushes the shipping rod S out of the cartridge and engages the cylinder barrel 24.

5. The valve block 12 is replaced by engaging locating pin 45 in hole 44 of the valve plate, and then bolted to the housing 10. As the bolts 43 are tightened, the valve block 12 presses against the valve plate 21 which forces the spring loaded tube against the angle block. This ensures positive sealing of the angle block against the housing.

6. The hydraulic fittings are replaced. The case is filled with clean oil which is provided in the cartridge container.

7. The unit is now ready to operate.

Among the advantages offered by the construction are the following:

1. Economical design due to minimum of parts required.

2. Higher overall efficiency of operation because of common drive shaft, resulting in fewer bearings and no coupling shaft.

3. Lower replacement cost since the housing and valve block are not routinely replaced.

4. All wear parts are replaced by exchange of the cartridge.

5. All seals are replaced by exchange of the cartridge.

6. Does not require special tools or technological training to service.

We claim:

1. In a fluid pressure energy translating device comprising a housing defining a cavity into one end of which a drive shaft is adapted to extend, said cavity having an open end remote from said drive shaft and a removable valve block closing the open end of said housing, said block having an inlet and outlet, a removable cartridge adapted to be positioned in said cavity, said cartridge comprising (a) a valve plate adapted to engage said valve block and an angle block, (b) a rotatable cylinder barrel adapted to be in abutment with said valve plate and in driving relation with a drive shaft, said cylinder barrel having a plurality of piston cylinders, each of which has a port for communicating the cylinders with a face of the valve plate, said housing supporting a bearing for said shaft externally of the cartridge, the portion of said shaft extending into said cartridge being unsupported by bearings within said housing or cartridge, said valve plate having arcuate ports communicating with the cylinder ports and adapted to communicate with the inlet and outlet of said valve block when the cylinder barrel is rotated relative to said housing, (c) a piston in each said cylinder, (d) shoes connected said pistons, said angle block having an inclined surface engaged by said shoes, and (e) means interconnecting said valve plate and angle block to form said removable cartridge.

2. The cartridge set forth in claim 1 wherein said means interconnecting said valve plate and said angle block comprises a tubular casing having one end thereof attached to said valve plate and the other end thereof attached to said angle block.

3. The cartridge set forth in claim 2 wherein said one end of said tubular casing is fixed to said valve plate and the other end of said tubular casing has relative axial movement with respect to said angle block.

4. The cartridge set forth in claim 3 wherein said means interconnecting said valve plate and said angle block further includes means providing limited axial movement between said tubular casing and said angle block.

5. A fluid pressure energy translating device comprising a housing, said housing defining a cavity, a drive shaft having a portion thereof rotatably mounted in the housing and extending into said cavity, said cavity having an open end remote from said drive shaft, a removable valve block closing the open end of said housing, said block having an inlet and outlet, and a removable cartridge positioned in said cavity between said valve block and drivingly engaged with said shaft, said cartridge comprising (a) a valve plate engaging said valve block and an angle block, (b) a rotatable cylinder barrel interposed between said valve plate and said angle block in abutment with said valve plate and in driving relation with said drive shaft, said housing supporting a bearing for said shaft externally of the cartridge, the portion of said shaft extending into said cartridge being unsupported by bearings within said housing or cartridge, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each cylinder, (d) shoes connected to said pistons, said angle block having an inclined surface engaged by said shoes, (e) means interconnecting said valve plate and angle block to form said removable cartridge such that the removable cartridge can be removed and replaced by disengaging the cartridge from said shaft.

6. The fluid pressure energy translating device set forth in claim 5 including an annular seal mounted in said angle block for sealingly engaging said shaft.

7. The fluid pressure energy translating device set forth in claim 5 wherein said means interconnecting said valve plate and said angle block comprises a tubular casing having one end thereof attached to said valve plate and the other end thereof attached to said angle block.

8. The fluid pressure energy translating device set forth in claim 7 wherein said one end of said tubular casing is fixed to said valve plate and the other end of said tubular casing has relative axial movement with respect to said angle block.

9. The fluid pressure energy translating device set forth in claim 8 wherein said means interconnecting said valve plate and said angle block further includes means providing limited axial movement between said casing and said angle block.

10. A fluid pressure energy translating device comprising a housing, said housing defining a cavity into one end of which a drive shaft is adapted to extend, said cavity having an open end remote from said one end, a removable valve block closing the open end of said housing, said block having an inlet and outlet, and a cartridge positioned in said cavity between said valve block and drivingly engaged with said shaft, said cartridge comprising (a) a valve plate engaging said valve block and an angle block, (b) a rotatable cylinder barrel in abutment with said valve plate and adapted to be in driving relation with a drive shaft, said housing supporting a bearing for said shaft externally of the cartridge, the portion of said shaft extending into said cartridge being unsupported by bearings within said housing or cartridge, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each said cylinder, ;p1 (d) shoes connected to said pistons, said angle block having an inclined surface engaged by said shoes, and (e) means interconnecting said valve plate and angle block to form a removable cartridge such that the removable cartridge can be removed and replaced by disengaging the cartridge from said shaft.

11. The fluid pressure energy translating device set forth in claim 10 wherein said means interconnecting said valve plate and said angle block comprises a tubular casing having one end thereof attached to said valve plate and the other end thereof attached to said angle block.

12. The fluid pressure energy translating device set forth in claim 11 wherein said one end of said tubular casing is fixed to said valve plate and the other end of said tubular casing has relative axial movement with respect to said angle block.

13. The fluid pressure energy translating device set forth in claim 12 wherein said means interconnecting said valve plate and said angle block further includes means providing limited axial movement between said casing and said angle block.

14. The fluid pressure energy translating device set forth in claim 13 wherein said means providing limited axial movement comprising a radially extending pin in said angle block and an opening in said tubular casing, said opening being elongated in an axial direction to provide limited relative axial movement between said tubular casing and said angle block.

15. A fluid pressure energy translating device comprising a housing, said housing defining a cavity, a drive shaft having a portion thereof rotatably mounted in the housing and extending into said cavity, said cavity having an open end remote from said drive shaft, a removable valve block closing the open end of said housing, said block having an inlet and outlet, and a removable cartridge positioned in said cavity between said valve block and drivingly engaged with said shaft, said cartridge comprising (a) a valve plate engaging said valve block and an angle block, (b) a rotatable cylinder barrel interposed between said valve plate and said angle block in abutment with said valve plate and in driving relation with said drive shaft, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each cylinder, (d) shoes connected to said pistons, said angle block having an inclined surface engaged by said shoes, (e) means interconnecting said valve plate and angle block to form said removable cartridge such that the removable cartridge can be removed and replaced by disengaging the cartridge from said shaft, longitudinally spaced annular seals on the periphery of said cartridge engaging the sides of the cavity in said housing.

16. A fluid pressure energy translating device comprising a housing, said housing defining a cavity into one end of which a drive shaft is adapted to extend, said cavity having an open end remote from said one end, a removable valve block closing the open end of said housing, said block having an inlet and outlet, and a cartridge positioned in said cavity between said valve block and drivingly engaged with said shaft, said cartridge comprising (a) a valve plate engaging said valve block and an angle block, (b) a rotatable cylinder barrel in abutment with said valve plate and adapted to be in driving relation with a drive shaft, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each said cylinder, (d) shoes connected to said pistons, said angle block having an inclined surface engaged by said shoes, and (e) means interconnecting said valve plate and angle block to form a removable cartridge such that the removable cartridge can be removed and replaced by disengaging the cartridge from said shaft, a removable rod extending into said cartridge and maintaining said cylinder barrel and associate parts radially in said cartridge before the cartridge is inserted or after the cartridge has been removed.

17. In a fluid pressure energy translating device comprising a housing defining a cavity into one end of which a drive shaft is adapted to extend, said cavity having an open end remote from said drive shaft and a removable valve block closing the open end of said housing, said block having an inlet and outlet, a removable cartridge adapted to be positioned in said cavity, said cartridge comprising (a) a valve plate adapted to engage said valve block and an angle block, (b) a rotatable cylinder barrel adapted to be in abutment with said valve plate and in driving relation with a drive shaft, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each said cylinder, (d) shoes connected said pistons, said angle block having an inclined surface engaged by said shoes, and (e) means interconnecting said valve plate and angle block to form said removable cartridge, a removable rod extending into said cartridge and maintaining said cylinder barrel and associate parts radially in said cartridge before the cartridge is inserted or after the cartridge has been removed.

18. In a fluid pressure energy translating device comprising a housing defining a cavity into one end of which a drive shaft is adapted to extend, said cavity having an open end remote from said drive shaft and a removable valve block closing the open end of said housing, said block having an inlet and outlet, a removable cartridge adapted to be positioned in said cavity, said cartridge comprising (a) a valve plate adapted to engage said valve block and an angle block, (b) a rotatable cylinder barrel adapted to be in abutment with said valve plate and in driving relation with a drive shaft, said housing supporting a bearing for said shaft externally of the cartridge, the portion of said shaft extending into said cartridge being unsupported by bearings within said housing or cartridge, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each said cylinder, (d) shoes connected to said pistons, said angle block having an inclined surface engaged by said shoes, and (e) means interconnecting said valve plate and angle block to form said removable cartridge, said means interconnecting said valve plate and said angle block comprising a tubulr casing having one end thereof attached to said valve plate and the other end thereof attached to said angle block, said one end of said tubular casing being fixed to said valve plate and the other end of said tubular casing having relative axial movement with respect to said angle block, said means interconnecting said valve plate and said angle block further including means providing limited axial movement between said tubular casing and said angle block, said means providing limited axial movement comprising a radially extending pin in said angle block and an opening in said tubular casing, said opening being elongated in an axial direction to provide limited relative axial movement between said tubular casing and said angle block.

19. In a fluid pressure energy translating device comprising a housing defining a cavity into one end of which a drive shaft is adapted to extend, said cavity having an open end remote from said drive shaft and a removable valve block closing the open end of said housing, said block having an inlet and outlet, a removable cartridge adapted to be positioned in said cavity, said cartridge comprising (a) a valve plate adapted to engage said valve block and an angle block, (b) a rotatable cylinder barrel adapted to be in abutment with said valve plate and in driving relation with a drive shaft, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each said cylinder, (d) shoes connected to said pistons, said angle block having an inclined surface engaged by said shoes, and (e) means interconnecting said valve plate and angle block to form said removable cartridge, said means interconnecting said valve plate and said angle block comprising a tubular casing having one end thereof attached to said valve plate and the other end thereof attached to said angle block, said one end of said tubular casing being fixed to said valve plate and the other end of said tubular casing having relative axial movement with respect to said angle block, said means interconnecting said valve plate and said angle block further including means providing limited axial movement between said tubular casing and said angle block, said means providing limited axial movement comprising a radially extending pin in said angle block and an opening in said tubular casing, said opening being elongated in an axial direction to provide limited relative axial movement between said tubular casing and said angle block, spring means interposed between said tubular casing and said valve block.

20. The cartridge set forth in claim 19 including longitudinally spaced annular seals on the periphery of said cartridge engaging the sides of the cavity in said housing.

21. The cartridge set forth in claim 20 including an annular seal mounted in said angle block for sealingly engaging said shaft.

22. A fluid pressure energy translating device comprising a housing, said housing defining a cavity, a drive shaft having a portion thereof rotatably mounted in the housing and extending into said cavity, said cavity having an open end remote from said drive shaft, a removable valve block closing the open end of said housing, said block having an inlet and outlet, and a removable cartridge positioned in said cavity between said valve block and drivingly engaged with said shaft, said cartridge comprising (a) a valve plate engaging said valve block and an angle block, (b) a rotatable cylinder barrel interposed between said valve plate and said angle block in abutment with said valve plate and in driving relation with said drive shaft, said cylinder barrel having a plurality of piston cylinders, each of which has a port for communicating the cylinders with a face of the valve plate, said valve plate having arcuate ports communicating with the cylinder ports and adapted to communicate with the inlet and outlet of said valve block when the cylinder barrel is rotated relative to said housing, (c) a piston in each cylinder, (d) shoes connected to said pistons, said angle block having an inclined surface engaged by said shoes, (e) means interconnecting said valve plate and angle block to form said removable cartridge such that the removable cartridge can be removed and replaced by disengaging the cartridge from said shaft, said means interconnecting said valve plate and said angle block comprising a tubular casing having one end thereof attached to said valve plate and the other end thereof attached to said angle block, said one end of said tubular casing being fixed to said valve plate and the other end of said tubular casing having relative axial movement with respect to said angle block, said means interconnecting said valve plate and said angle block further including means providing limited axial movement between said casing and said angle block, said means providing limited axial movement comprising a radially exending pin in said angle block and an opening in said tubular casing, said opening being elongated in an axial direction to provide limited relative axial movement between said tubular casing and said angle block, spring means interposed between said tubular casing and said angle block.

23. A fluid pressure energy translating device comprising a housing, said housing defining a cavity into one end of which a drive shaft is adapted to extend, said cavity having an open end remote from said one end, a removable valve block closing the open end of said housing, said block having an inlet and outlet, and a cartridge positioned in said cavity between said valve block and drivingly engaged with said shaft, said cartridge comprising (a) a valve plate engaging said valve block and an angle block, (b) a rotatable cylinder barrel in abutment with said valve plate and adapted to be in driving relation with the drive shaft, said cylinder barrel having a plurality of piston cylinders, each of which has a port for communicating the cylinders; wlth a face of the valve plate, said valve plate having arcuate ports communicating with the cylinder ports and adapted to communicate with the inlet and outlet of said valve block when the cylinder barrel is rotated relative to said housing, (c) a piston in each said cylinder, (d) shoes connected to said pistons, said angle block having an inclined surface engaged by said shoes, and (e) means interconnecting said valve plate and angle block to form a removable cartridge such that the removable cartridge can be removed and replaced by disengaging the cartridge from said shaft, said means interconnecting said valve plate and said angle block comprising a tubular casing having one end thereof attached to said valve plate and the other end thereof attached to said angle block, said one end of said tubular casing being fixed to said valve plate and the other end of said tubular casing having relative axial movement with respect to said angle block, said means interconnecting said valve plate and said angle block further including means providing limited axial movement between said casing and said angle block, said means providing limited axial movement comprising a radially extending pin in said angle block and an opening in said tubular casing, said opening being elongated in an axial direction to provide limited relative axial movement between said tubular casing and said angle block, spring means interposed between said tubular casing and said angle block.

24. The fluid pressure energy translating device set forth in claim 23 including longitudinally spaced annular seals on the periphery of said cartridge engaging the sides of the cavity in said housing.

25. The fluid pressure energy translating device set forth in claim 24 including an annular seal mounted in said angle block for sealingly engaging said shaft.

26. The cartridge set forth in any of claims 1–4, 23, 17 in combination with a container for receiving the device, oil in said container, and a closure.

* * * * *